US005700974A

United States Patent [19]

Taylor

[11] Patent Number: 5,700,974

[45] Date of Patent: Dec. 23, 1997

[54] PREPARING CONSOLIDATED THERMITE COMPOSITIONS

[75] Inventor: Robert D. Taylor, Hyrum, Utah

[73] Assignee: Morton International, Inc., Chicago, Ill.

[21] Appl. No.: 806,083

[22] Filed: Feb. 25, 1997

Related U.S. Application Data

[62] Division of Ser. No. 533,112, Sep. 25, 1995, Pat. No. 5,650,590.

[51] Int. Cl.[6] ..... C06B 21/00

[52] U.S. Cl. ..... 149/109.6; 149/37; 149/17

[58] Field of Search ..... 149/37, 109.6, 149/17

[56] References Cited

U.S. PATENT DOCUMENTS

| | | | |
|---|---|---|---|
| 4,084,078 | 4/1978 | Schroeder | 219/121 P |
| 4,585,158 | 4/1986 | Wardlaw, III | 228/232 |
| 4,832,703 | 5/1989 | Campana et al. | 44/519 |
| 5,129,305 | 7/1992 | Reilly | 89/1.11 |
| 5,178,696 | 1/1993 | Ikeda et al. | 149/35 |
| 5,236,526 | 8/1993 | Perotto | 149/35 |
| 5,429,691 | 7/1995 | Hinshaw et al. | 149/45 |
| 5,439,537 | 8/1995 | Hirshaw et al. | 149/37 |
| 5,518,268 | 5/1996 | Moore et al. | 280/737 |
| 5,531,845 | 7/1996 | Flanigan et al. | 149/109.6 |

*Primary Examiner*—Edward A. Miller

*Attorney, Agent, or Firm*—George W. Rauchfuss, Jr.; Gerald K. White

[57] ABSTRACT

An improved heat generating thermite composition suitable for use in an inflator of a motor vehicle airbag restraint system comprises a hard consolidated pellet, grain or wafer shaped formulation of a powdered metal fuel, a powdered metal oxide oxidizer, a binder and a supplemental oxidizing agent.

10 Claims, No Drawings

PREPARING CONSOLIDATED THERMITE COMPOSITIONS

This application is a Divisional Application of application Ser. No. 08/533,112. filed on Sep. 25, 1995 now U.S. Pat. No. 5,650,590.

FIELD OF THE INVENTION

This invention relates to improved thermite compositions for use in stored gas type inflators for inflatable airbag restraint systems of motor vehicles.

BACKGROUND OF THE INVENTION

Automotive supplemental inflatable restraint systems, such as airbag cushion restraint systems, have conventionally employed pyrotechnic inflators, such as inflators containing azide-based gas-generating compositions, to provide inflation gases for inflating the airbag cushion. While pyrotechnic based inflators have provided acceptable airbag inflation, such systems are not without their drawbacks and disadvantages. For example, ignition and burning of the pyrotechnic gas-generating materials produces undesirable hot particulate by-products which can cause damage to the airbag or a vehicle occupant. A considerable amount of effort has gone into producing a pyrotechnic based airbag inflation system in which the inflator traps generated hot particulate material within the inflator body itself so that it cannot escape to damage the airbag. Also, considerable effort has gone into attempts to eliminate the production of such hot particulate materials. Additionally, such pyrotechnic gas-generating compositions pose a problem due to the toxicity of the gas produced.

More recently it has been proposed to replace such pyrotechnic based inflation system with hybrid inflators in which the main proportion of the inflation gases is provided by stored pressurized gas in the inflator. However, such hybrid inflators generally still require the presence of pyrotechnic materials (albeit in a reduced amount) in order to provide ignition and thereby provide supplemental inflation gases and to heat the pressurized stored gas in order to arrange for the release of the stored gas, such as, for example, by providing means or additional pressure to rupture burst disks in the inflator to release the stored pressurized gas.

Even more recently it has been proposed, in co-pending application Ser. No. 08/423,261, filed Apr. 17, 1995, now U.S. Pat. No. 5,533,751, issued Jul. 9, 1996, and assigned to the Assignee of this Application, to provide a co-flow hybrid type inflator in which a non gas-producing thermite composition is ignited by an ignitor material (such as boron potassium nitrate). Stored pressurized gas is caused to flow over and/or through the exothermic thermite reaction product to produce heated pressurized gas sufficient to effectively inflate an inflatable airbag restraint cushion. Such a co-flow hybrid inflator employing a thermite composition is disclosed in FIGS. 6 to 9 and the description at pages 8 to 13 of said co-pending Application, which Application is incorporated herein by reference thereto.

The aforementioned co-pending Application mentions the use of a thermite composition of aluminum metal fuel and iron oxide oxidizer with the possible addition of supplemental oxidizing agent potassium perchlorate as a burn enhancer. However, it has been discovered that attempts to produce inflators employing such thermite compositions as a non-gas producing heat source for stored pressurized gas in such a co-flow hybrid inflator have not been entirely successful. For one thing, it has not been possible to acceptably consolidate these non-water soluble ingredients of the thermite compositions into pellets, grains or wafers for use in an inflator. Additionally, such thermite compositions by themselves have been found to be very difficult to ignite. Moreover, the temperature needed to ignite the thermite compositions has been undesirably high.

It is therefore desirable to provide an improved thermite compositions for use in motor vehicle airbag inflators which compositions are readily able to be consolidated into pellets, grains, wafers, or the like. It is also desirable to provide such improved thermite compositions which are able to ignite at an acceptably low ignition temperature, for example, at a temperature of about 2000° C. or less. It is also desirable to provide improved thermite compositions of the aforesaid properties and characteristics which compositions still generate heat producing chemical reactions generating little or no gas to augment the performance of stored pressurized gas hybrid inflators and yet still increases the temperature and performance of the stored pressurized gas inflator due to the heat generating characteristics of the improved thermite compositions. It would also be highly desirable if such improved thermite compositions would not produce any significant hot particulate by-product materials. It is also desirable if such improved thermite compositions could be provided with the foregoing characteristics and yet be able to ignite at an acceptably low ignition temperature while still provide inflation performance essentially equivalent to a standard pyrotechnic—stored gas hybrid inflator.

SUMMARY OF THE INVENTION

Improved thermite compositions for use in inflators for airbag restraint systems of motor vehicles are provided in accordance with this invention by consolidated compositions of water insoluble metal fuels and metal oxide oxidizing agents, an acceptable binder and a small amount of a supplemental oxidizing agent. The consolidated thermite compositions may be formed into pellets, or grains or wafers for use in automotive airbag inflators.

The water insoluble metal fuel and metal oxide oxidizing agent, binder and supplemental oxidizing agent are mixed into a suitable slurring medium, such as water, to form a slurry which is extruded and chopped into the desired form such as pellets, grains, wafers, or the like.

DETAILED DESCRIPTION OF THE INVENTION

The improved thermite compositions of this invention comprise consolidated thermite compositions of water insoluble metal fuels and metal oxide oxidizers, an acceptable binder and a supplemental oxidizing agent.

The improved thermite compositions of this invention employ finely divided metal fuels and metal oxide oxidizing agents. The desired exothermic reaction is produced upon ignition of the composition by oxygen breaking away from the metal oxide and reoxidizing with the metal fuel. Any suitable finely divided metal fuel know for use in thermite compositions may be used in the improved compositions of this invention. As examples of suitable finely divided metal fuels there may be mentioned, aluminum, titanium, titanium hydride, vanadium, boron and the like, preferably aluminum powder. As examples of suitable metal oxide oxidizers there may be mentioned, ferric oxide ($Fe_2O_3$), titanium oxide (TiO), cupric oxide (CuO), cobaltic oxide ($Co_2O_3$), cobaltous ferrite ($CoFe_2O_4$), manganese dioxide ($MnO_2$) and the like. The finely divided metal fuels and metal oxide oxidizers will generally have a particle size of from about 0.01 to about 300 microns and preferably from about 0.1 to about 100 microns. Most preferably, the particle size of the metal fuel will be about 5 to about 30 microns and the particle size of the metal oxide oxidizer about 0.1 to 3 microns.

The supplemental oxidizing agent can be any acceptable oxidizing agent but is preferably ammonium perchlorate ($NH_4ClO_4$), potassium perchlorate ($KClO_4$) or potassium chlorate ($KClO_3$) in order to improve the ignitability of the improved consolidated thermite compositions.

As a binder suitable to enable the thermite compositions to be consolidated in an acceptable manner yet producing essentially no unacceptable hot particulate materials upon ignition thereof, there may be mentioned hydrated calcium sulfate ($CaSO_4.2H_2O$).

In the improved thermite compositions of this invention the finely divided metal fuel is generally present in an amount of from about 20 to about 30% by weight, the metal oxide oxidizer in an amount of from about 40 to about 70% by weight, the binder in an amount of from about 5 to about 25% by weight, preferably about 5 to 10% by weight, and the supplemental oxidizing agent in an amount of from about 2 to about 10% by weight. Generally the binder will be employed at the lowest level at which acceptable consolidation can be achieved in order not to unduly decrease the flame temperature of the igniting composition which would undesirably reduce the ability of the igniting thermite composition to heat the stored pressurized gas. In general, therefore, it has been found that a level of binder of about 10% by weight is preferred. Similarly, it is generally desirable to use the least amount of additional or supplemental oxidizing agent necessary to provide for easy ignition of the improved thermite compositions since higher levels can produce safety concerns. For example, the amount of additional oxidizing agent, such as potassium perchlorate, is generally about 2.0% by weight since higher levels of about 5 to 10% by weight can produce compositions that are very sensitive to electrostatic discharge.

As examples of formulations that can be utilized to produce the improved consolidated thermite products of the invention, there may be mentioned the following representation formulations.

| | Formulation Number | | |
|---|---|---|---|
| Component | 1 | 2 | 3 |
| | Component weight % | | |
| Aluminum metal powder (5–30 microns) | 26.94 | 27.35 | 28.03 |
| Ferric oxide (0.1–3 microns) | 61.06 | 57.64 | 51.97 |
| Potassium perchlorate | 2.00 | 2.00 | 2.00 |
| Hydrated calcium sulfate | 10.00 | 10.00 | 10.00 |

An improved thermite formulation of this invention is consolidated into suitable pellets, grains or wafers in the following manner, utilizing Formulation No. 1, as described above. The ingredients of the formulation are processed into pellets by slurry mixing the ingredients in water (about 46% by weight) into an intimate mixture of components and then extruding the slurry mixture and chopping or cutting the extruded material to form pellets of approximately 0.25 inches (6.35 mm) in diameter and 0.25 inches (6.35 mm) in length. After forming the cylindrical shaped pellets from the extruded slurry mixture, the pellets material is dried to a hard consolidated shape in any suitable drying oven by driving off the water slurry medium.

An improved consolidated thermite composition, such as the pellets formed in the preceding paragraph, can be employed as the heat-producing, non gas-producing materials in hybrid inflators, especially of the co-flow type described in the aforementioned co-pending application Ser. No. 08/423,261. Such improved consolidated thermite compositions are capable of producing large quantities of intense heat without producing any significant amount of gas or hot particulate material. Moreover, the improved consolidated thermite compositions ignite at an acceptable low ignition temperature, generally within the range of about 1500° to 2200° C., and generally below about 2000° C.

With the foregoing description of the invention, those skilled in the art will appreciate that modifications may be made to the invention without departing from the spirit thereof. Therefore, it is not intended that the scope of the invention be limited to the specific embodiments illustrated and described.

I claim:

1. A process for producing a hard consolidated form of heat generating thermite composition suitable for use in an inflator for an airbag restraint system of a motor vehicle, said process comprising:

1) mixing in a slurry medium until in intimate admixture:
   a) about 20 to about 30 weight percent of a powdered metal fuel,
   b) about 40 to about 70 weight percent of a powdered metal oxide oxidizer,
   c) about 5 to about 25% weight percent of an essentially non gas-producing, non hot particulate-producing binder, and
   d) about 2 to about 10 weight percent of a supplemental oxidizing agent,
2) extruding the resulting slurry mixture into a consolidated form,
3) cutting the consolidated extruded slurry mixture into appropriately sized and shaped pellets, grains or wafer forms,
4) drying the pellet, grain or wafer forms to remove the slurry medium therefrom, to form the consolidated extruded slurry mixture forms into hard consolidated shapes.

2. The process of claim 1 wherein the slurry medium is water, the consolidated extruded slurry mixture is cut into pellets, the powdered metal fuel is aluminum powder of about 5 to about 30 microns particle size, the metal oxide oxidizer is ferric powder of about 0.1 to 3 microns particle size, the binder is hydrated calcium sulfate and the supplemental oxidizing agent is potassium perchlorate.

3. The process of claim 1 wherein the powdered metal fuel has a particle size of about 5 to 30 microns and the powdered metal oxide oxidizer has a particle size of about 0.1 to 3 microns.

4. The process of claim 1 wherein the binder is hydrated calcium sulfate and the supplemental oxidizing agent is selected from the group consisting of potassium perchlorate, potassium chlorate and ammonium perchlorate.

5. The process of claim 1 wherein the binder is hydrated calcium sulfate and the supplemental oxidizing agent is selected from the group consisting of potassium perchlorate, potassium chlorate and ammonium perchlorate.

6. The process of claim 1 wherein the powdered metal fuel is aluminum metal powder and the metal oxide oxidizer is ferric oxide powder.

7. The process of claim 3 wherein the powdered metal fuel is aluminum metal powder and the metal oxide oxidizer is ferric oxide powder.

8. The process of claim 4 wherein the powdered metal fuel is aluminum metal powder and the metal oxide oxidizer is ferric oxide powder.

9. The process of claim 5 wherein the powdered metal fuel is aluminum metal powder and the metal oxide oxidizer is ferric oxide powder.

10. The process of claim 1 wherein:

a) the powdered metal fuel has a particle size of from about 5 to 30 microns and is selected from the group consisting of aluminum, titanium, titanium hydride, vanadium and boron powder, b) the powdered metal oxide oxidizer has a particle size of from about 0.1 to 3 microns and is selected from the group consisting of ferric oxide, titanium oxide, cupric oxide, cobaltic oxide, cobaltous ferrite and manganese oxide, c) the binder is hydrated calcium sulfate in an amount of about 5 to 10% weight percent, and d) the supplemental oxidizing agent is selected from potassium perchlorate, potassium chlorate and ammonium perchlorate and is present in an amount of from about 5 to about 10 weight percent.

* * * * *